United States Patent [19]

Laman

[11] 3,946,680

[45] Mar. 30, 1976

[54] BURNING USED TIRES, ETC. AND APPARATUS THEREFOR

[75] Inventor: Joseph R. Laman, Akron, Ohio

[73] Assignee: The Firestone Tire & Rubber Company, Akron, Ohio

[22] Filed: Dec. 23, 1974

[21] Appl. No.: 535,251

[52] U.S. Cl. ..... 110/18 C; 110/38; 110/40 R

[51] Int. Cl.[2] ..... F23G 7/00; F23G 5/12

[58] Field of Search ..... 110/7 R, 7 B, 8 R, 8 C, 110/8 A, 18 R, 18 C, 28 J, 40 R, 38

[56] References Cited

UNITED STATES PATENTS

| | | | |
|---|---|---|---|
| 3,397,657 | 8/1968 | Tada | 110/28 |
| 3,565,021 | 2/1971 | Hill | 110/7 |
| 3,680,500 | 8/1972 | Pryor | 110/8 |
| 3,702,595 | 11/1972 | Muirhead et al. | 110/28 |
| 3,779,183 | 12/1973 | Brion | 110/18 |
| 3,780,674 | 12/1973 | Liu | 110/8 |
| 3,785,304 | 1/1974 | Stookey | 110/8 |
| 3,848,549 | 11/1974 | Pryor et al. | 110/8 |
| 3,861,331 | 1/1975 | Saitoh et al. | 110/8 |

*Primary Examiner*—Kenneth W. Sprague

[57] ABSTRACT

Waste which contains a substantial amount of material which melts and drips as it burns, is used as the source material. The process is adapted to not only dispose of the waste, but also to provide heat for generating steam and other useful purposes. The invention is used very advantageously for the burning of vulcanized rubber wastes with control of the gases so that they do not cause an environmental hazard.

The waste may be reduced to particle size, but this is not necessary. Whole old tires may be used.

The meltable waste is burned over means which collects the drip and does not let it collect in and plug openings in conveyor means used in the combustion process. A very satisfactory means for collecting the drip is a bed of non-combustible balls or other particulate material carried by a conveyor, which bed prevents any substantial amount of the drip from being collected by the conveyor. Such non-combustible particulate material may be formed of steel, aluminum, ceramic material, etc. The waste material may rest on the bed and be carried through the combustion chamber supported by the bed, or the waste material may be carried through the chamber above the bed which collects the drip. In such a procedure, the waste (such as old tires) may be carried through the combustion chamber on hooks or the like on a continuous conveyor, or large pieces of such waste may be carried through the combustion chamber resting on a conveyor provided with sufficient open spaces to allow the drip to pass therethrough, and this drip may be collected below the conveyor on a continuously moving bed such as described. The drip from waste carried on such a conveyor may be collected in any other suitable manner.

If the waste is composed of a mass of small particles it must be spread on the conveying support in such a manner that air required for combustion can pass up through it, and if the waste rests on a bed of non-combustible balls or other particulate matter, the air must pass up through openings therein, and the melt from the waste must not be allowed to plug the openings. If the waste is in large pieces (such as old tires) the pieces may be suspended from a conveyor, or they may rest on a bed of balls or other particulate matter which prevents the melt from passing into openings in the conveyor that supports the bed, or the bed may be omitted if openings in the conveyor are so large that the melt will not plug them.

Oil and/or gas is usually supplied to the combustion chamber above and/or below the grate to provide the temperature required for any commercial use of the combustion, and for combustion of the waste when necessary. If the waste contains sulfur, the amount of oil and/or gas used is controlled so that the sulfur dioxide content of the exhaust gases does not exceed a predetermined limit. If the waste is substantially free of sulfur and burned solely to dispose of it, it is not necessary to use any oil or gas, except perhaps to start the fire or to keep the fire burning.

The heat generated may be supplied to a boiler or be otherwise used for a beneficial purpose. Thus, not only does the process provide for the disposal of waste, but also utilizes the heat generated, and if the waste contains sulfur this may be done without polluting the atmosphere.

26 Claims, 10 Drawing Figures

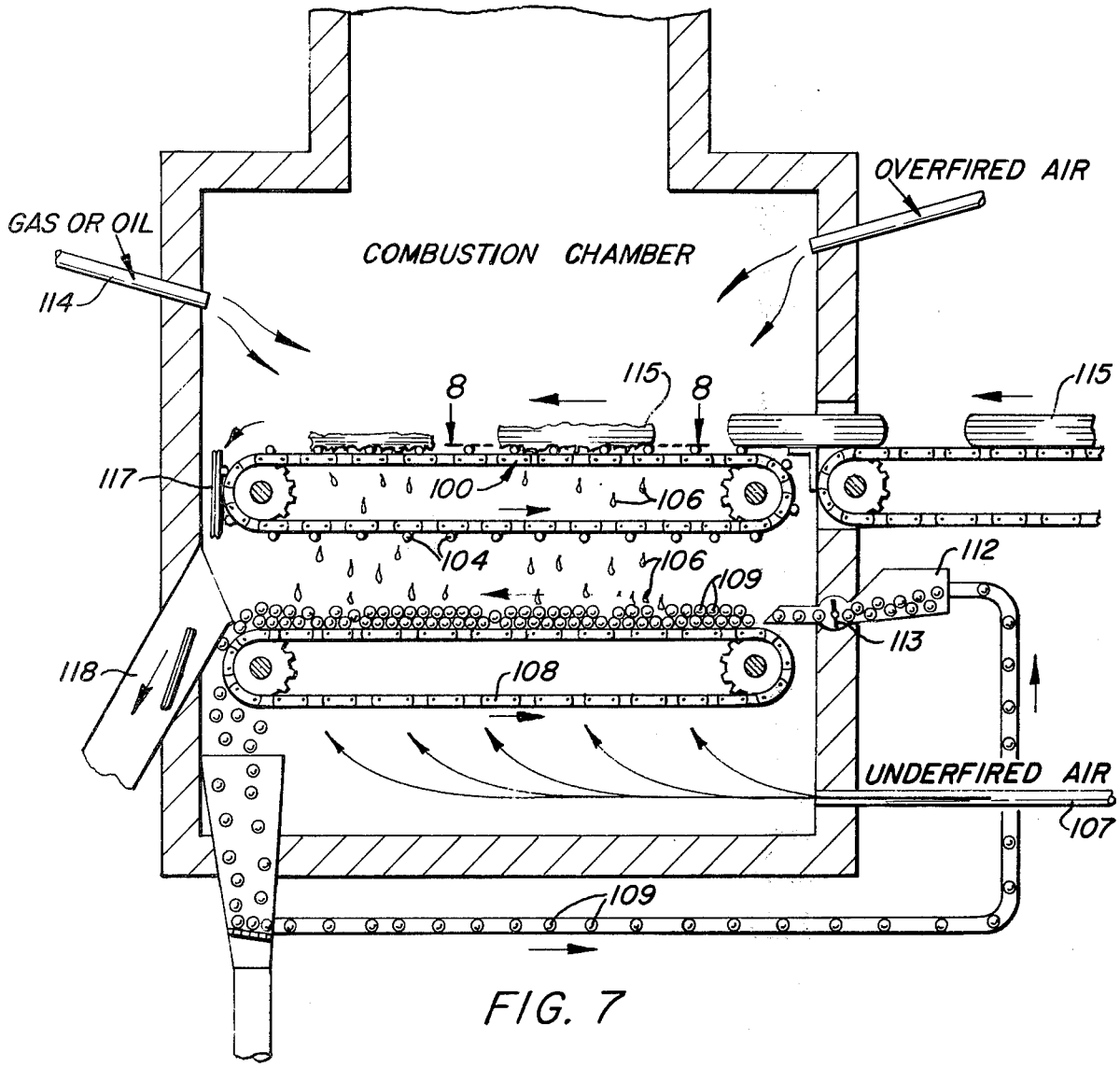
FIG. 7
FIG. 8
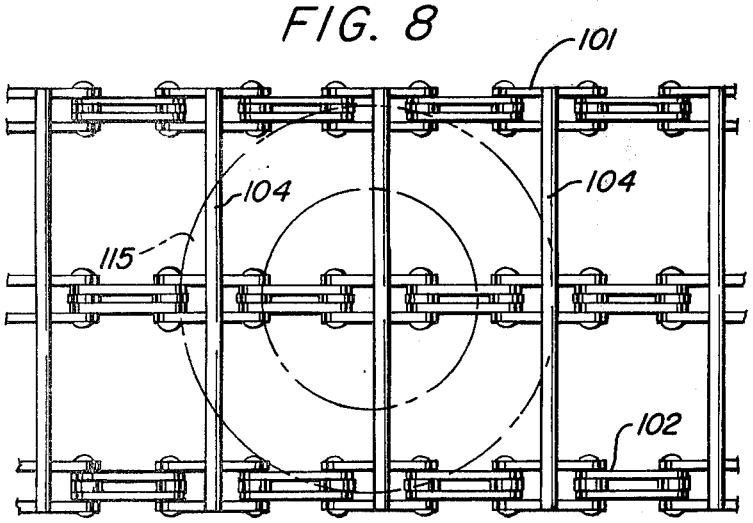

BURNING USED TIRES, ETC. AND APPARATUS THEREFOR

PRIOR ART

Attempts have been made to use the heat from the burning of waste vulcanized rubber and/or other waste that melts as it burns. In some of these attempts, the waste has melted onto a grate and as it melted it blocked openings in the grate and this prevented the passage of air up through the grate.

Other processes of burning such waste which have been successful, utilize high temperatures and expensive equipment. The present process may be carried out in a modification of existing equipment.

Whole tires have been burned in equipment that makes no provision for balancing the resulting gas with gas of low sulfur dioxide content which results from the burning of fuel to produce a waste gas with a sulfur dioxide content less than a previously set maximum. The equipment used has not provided a support for tires having openings therethrough for feeding air (or other oxygen-containing gas) upwardly therethrough to feed the flame. For instance, whole tires have been burned in an imperforate cylindrical kiln-type furnace rotated on a tilted axis. Also, "Scrap Tire Disposal" by Beckman, Crane, Kay and Laman in Rubber Chemistry and Technology, Vol. 47, No. 3, for July 1974 pages 597–624 on page 609 refers to burning whole tires in an incinerator chamber on an imperforate floor which is rotated similarly to the floor of a rotating hearth, with sufficient air and fuel such as oil and/or gas to sustain the incinerator operation.

SUMMARY OF THE INVENTION

The process is designed for the disposal of waste that melts as it burns, and especially used tires and other vulcanized rubber and sulfur-containing wastes which contain sufficient sulfur to pollute the atmosphere when they are burned.

Any type of burner equipment may be adapted to use the process of this invention. Boilers of all types can burn waste as here described and heat from the burning of waste as here described may be used for other heating purposes. Installations designed only for the disposal of waste can use the process. Dry bottom boilers, chain-grate boilers, traveling-chain grate boilers, fixed-grate boilers, burners using pulverized coal and packaged boilers, etc. now in use can be readily converted to utilize the process of the invention. The burning equipment and accessories are not limited to what is shown or specifically described, but other installations may be used.

According to this invention, the drip from the meltable waste before it starts burning or as it burns, is handled in such a way that it does not plug the conveyor means used in the combustion process.

A very satisfactory procedure is to provide a bed of balls or other incombustible particulate matter under the waste. The waste may rest on this bed or, if the waste is in large pieces, such as old tires, it may be suspended above it. Also, tires and other large pieces of waste may be placed on a support provided with large openings which are too large to be plugged by drip or chunks which fall from the burning tires or other waste. They may be located over a bed of balls or other particulate matter on a conveyor or other means for disposing of such drip, etc.

Discarded tires present a pollution problem. They are unsightly and if burned on a trash pile or in any type of installation in which the heat produced is utilized, the gases pollute the atmosphere with sulfur dioxide and particulate matter. The gases from burning oil or gas may be mixed with the gas from the burning tires in a regulated amount, according to this invention, so that the sulfur dioxide of the total gas content is below a predetermined pollution level. The tires may be reduced to particles, and these particles may contain small parts of metal beads or belts embodied in them. These tire particles will be collected with the ash and disposed as a part of it. This process yields high grade zinc oxide, titanium dioxide, iron oxide, etc.

Thus, whole tires may be burned supported over a bed of incombustible particles. The tires may lie flat on the bed or be thrown thereon in a helter-skelter fashion. They may be placed two or more deep. They may be fed onto the bed of incombustible particles from any suitable conveyor means, or may even be thrown thereon by hand. Alternatively, they may be supported above such a bed while burning, with a bed of particulate matter or other means provided below this conveyor to collect the drip. The beads and other incombustible material from the tires are discharged with ash from the burning tires, and also the particles of the bed of incombustible matter if the tires are burned on such a bed. The incombustible particles are usually separated from the ash and returned to the grate.

Alternatively, the tires may be brought to the combustion chamber supported, usually individually, from hooks on a conveyor belt. As they burn, the melt may drip onto a bed of incombustible particles on a grate where it is burned to ash, or it may be disposed of in any suitable manner. The beads and other incombustible components of the tires, such as belts, etc. are preferably retained on the hooks until they leave the combustion chamber when they are disposed.

Air is introduced into the combustion chamber below the waste to provide oxygen for its combustion. If the heat from the combustion of the waste is to be used, fuel is burned in the combustion chamber to supplement the heat from the waste. Usually, gas and/or oil is preferred as the fuel although a low-sulfur coal (usually in powdered form) may be used. If the waste contains sufficient sulfur to produce an exhaust gas that contains sulfur dioxide in a concentration in excess of a predetermined limit, which may be a legal limit, fuel is burned in the chamber in sufficient quantity to provide an exhaust gas in which the sulfur dioxide content does not exceed the permitted maximum.

Waste that is reduced to particle size can be blown or otherwise spread over any suitable grate, using spreader equipment similar to that presently used for supplying coal to a grate, or other suitable equipment may be used. The particles may be supplied onto the grate in any manner, even by hand. Whether the waste is supported by the incombustible particles or is suspended above them, these particles collect the drip from the waste and it is burned to ash on these particles. Thus, the drip is prevented from collecting on the grate and clogging it, preventing the air from passing through it.

If a continuous traveling grate is used, the ash and particles of incombustible matter are dumped from the grate as it turns under, to travel back to the opposite end of the combustion chamber. The incombustible particles and ash are separated, as by screening, and the incombustible matter is usually fed back onto the grate.

Using a stationary grate, the incombustible particles are preferably of such a size that only the ash passes through the grate when it is shaken. If smaller incombustible particles are used, they pass through the grate with the ash and are usually separated from the ash and returned onto the grate.

If a bed of incombustible matter is used for collection and burning of the drip, it is advantageously carried by a traveling grate which dumps it as the grate turns downward, to be returned to the other end of the combustion chamber. Usually, the ash will be separated from the incombustible particles as they are spilled from the belt, but it may be necessary to agitate the particles or otherwise abrade them to remove the ash, before returning them for re-use on the grate.

Often meltable waste is reduced to particle size to facilitate handling. The particles may be as small as one-fourth inch or the waste may even be reduced to such a fineness that it is blown into the combustion chamber, and it may be burned above a grate which is covered with a bed of incombustible particles. It may be of such a fineness that most of the ash produced is carried up the stack with the flue gases. A precipitator may be used to prevent pollution of the air with fine ash. As the waste burns as it is carried up the stack, any melt formed may fall onto a bed of incombustible particles and burn there.

The incombustible particles are preferably ceramic or metal balls, because when used on a continuous grate, these can most easily be returned to the grate by rolling them. However, other incombustible particles of any shape may be used, such as particles of broken metal or ceramic articles, crushed brick and pieces of ash, which can be returned to the grate by conveyor belts or buckets, etc.

The incombustible particles are spread over the grate to provide a bed sufficiently thick to prevent any substantial amount of drip from the waste reaching the grate. It may be a couple of inches or more in depth, depending upon the nature and rate of feed of the waste, the temperature of the fire, etc. If the grate is a continuous grate, the openings through it are so small that the incombustible particles rest on its surface, and are discharged from it as the belt turns down to return to the other side of the combustion chamber. If the grate is a stationary grate, the bed is preferably composed of incombustible particles of such a size that they will not pass through the grate when it is shaken, and for this purpose the incombustible particles are smooth-surfaced and shaped so that they will remain above the grate when it is shaken.

The waste may be from a single source, such as old tires, but often will be composed of a mixture of paper, wood, plastic or other combustible material which includes incombustible trash such as tin cans, etc. If the waste contains sulfur, its sulfur content may be relatively constant, as the waste from a rubber plant which may include a percentage of unvulcanized rubber and other plastics, both vulcanized and unvulcanized, as well as vulcanized rubber. Other wastes composed largely of meltable plastic, including fabrics, scrap from containers and other packaging material, plastic shoe parts, etc. collected at a plastics fabricating plant, may contain little or no sulfur, and can be burned over particles of incombustible matter without the necessity of controlling the sulfur in the waste gases.

Any type of combustion chamber may be used for the disposal of meltable waste. The chamber may be under a boiler or the heat generated may be used for any other purpose whatsoever. The invention is even applicable to a disposal plant at which meltable waste is burned without utilization of the heat.

If the waste contains sulfur and is burned for heat, oil and/or gas is fed into the combustion chamber, usually above the fire on the grate, in sufficient quantity to supply the total heat required. In existing installations, the oil and/or gas may be supplied by means now employed, and burners of this general type may be used in future installations.

Gas used as fuel is generally substantially sulfur free. The oil used does not contain enough sulfur to raise the sulfur-dioxide content of the exhaust gases above the permitted maximum. If the waste contains so much sulfur that when burned alone, the sulfur-dioxide content of the exhaust gases is above the permitted maximum, a regulated quantity of gas and/or oil is burned in the chamber with the waste so that the total sulfur dioxide in the exhaust gases from both the waste and the fuel does not exceed the permitted maximum. This maximum may be a legal maximum.

Thus, waste rubber and other waste is consumed without environmental damage and it is burned without creating any environmental problem and often by revising existing equipment.

The invention is further described in connection with the accompanying drawings which are quite schematic, omitting insulation and usual accessories. In the drawings:

FIG. 7 is a section through the lower portion of a combustion chamber provided with one conveyor for carrying tires and another conveyor for disposing of the drip from the tires;

FIG. 8 is an enlarged plan view on the line 8—8 of FIG. 7;

Figure 1:
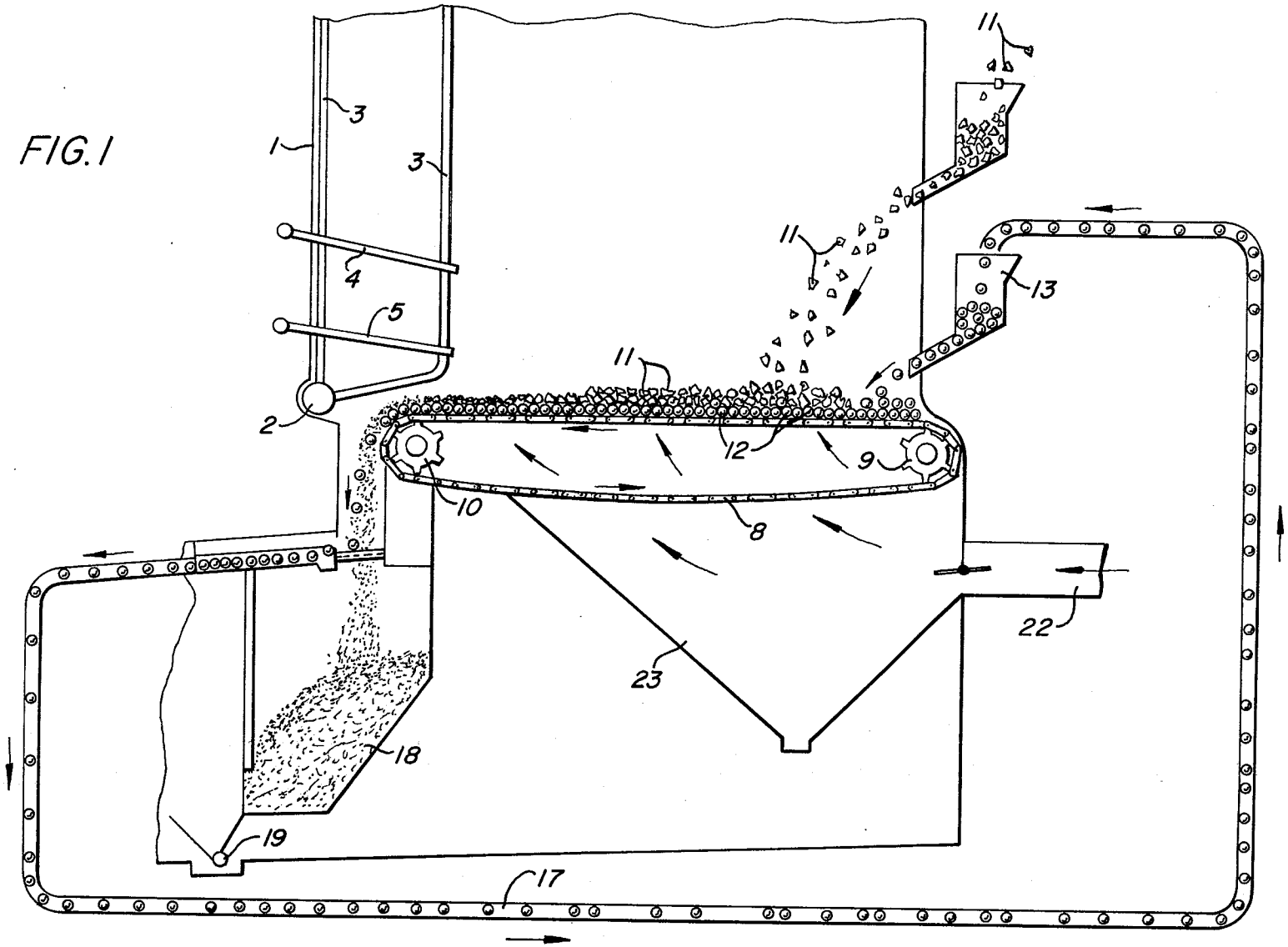
FIG. 1 is a section through the lower portion of a boiler equipped with a traveling-grate stoker.

FIG. 1 is a section through the bottom portion of a combustion chamber provided with a typical chain-grate or traveling-grate spreader stoker. It includes the insulated chamber 1 with the mud drum 2 of a boiler and connection pipes 3 connecting with a boiler (not shown) with oil and/or gas burners 4 and 5. The installation is provided with a traveling grate 8 supported on gears 9 and 10 which are driven by suitable means (not shown). Particles of waste 11 are fed into the hopper from which they are fed down onto the bed of incombustible particles 12. These incombustible particles are shown as balls which are fed from the hopper 13. They are fed onto the traveling grate 8 and are spilled off at one end as the grate travels around the gear 10. The ash and balls drop onto the screen 16 and from here the balls are carried through conveyor 17 by suitable means and discharged into the hopper 13. The ash collects in the chamber 18 and is directed into ash disposal conveyor 19.

Air is introduced through the conduit 22 by any suitable blower means and passes through the plenum 23 up through the grate 8 and bed of incombustible particles 12 and supplies air for the combustion of the waste particles 11. There are openings in the bed of particles 12 and in the grate which allow the air to pass up through them to provide oxygen for combustion of the waste. The balls or other particles 12 are too large to pass through the openings in the grate. Gas and/or oil is supplied to the upper part of the combustion chamber through any suitable means suggested by 4 and/or 5, and the heat from the combustion of the rubber is added to the heat from the burning fuel and passes up to generate steam in the boiler which is not shown.

As the waste particles are burned, any melt from them collects on the balls 12 which provide a bed of any desired thickness. The melt is consumed with the waste, and the whole is reduced to ash by the time it reaches a position over the gear 10. Here it is discharged with the incombustible particles onto the screen 16. The movement of the incombustible material as it is discharged over the end of the gear is usually sufficient to disengage any ash that may have adhered to it. If necessary, means may be provided for agitating the balls to abrade the ash from them.

Figure 2:
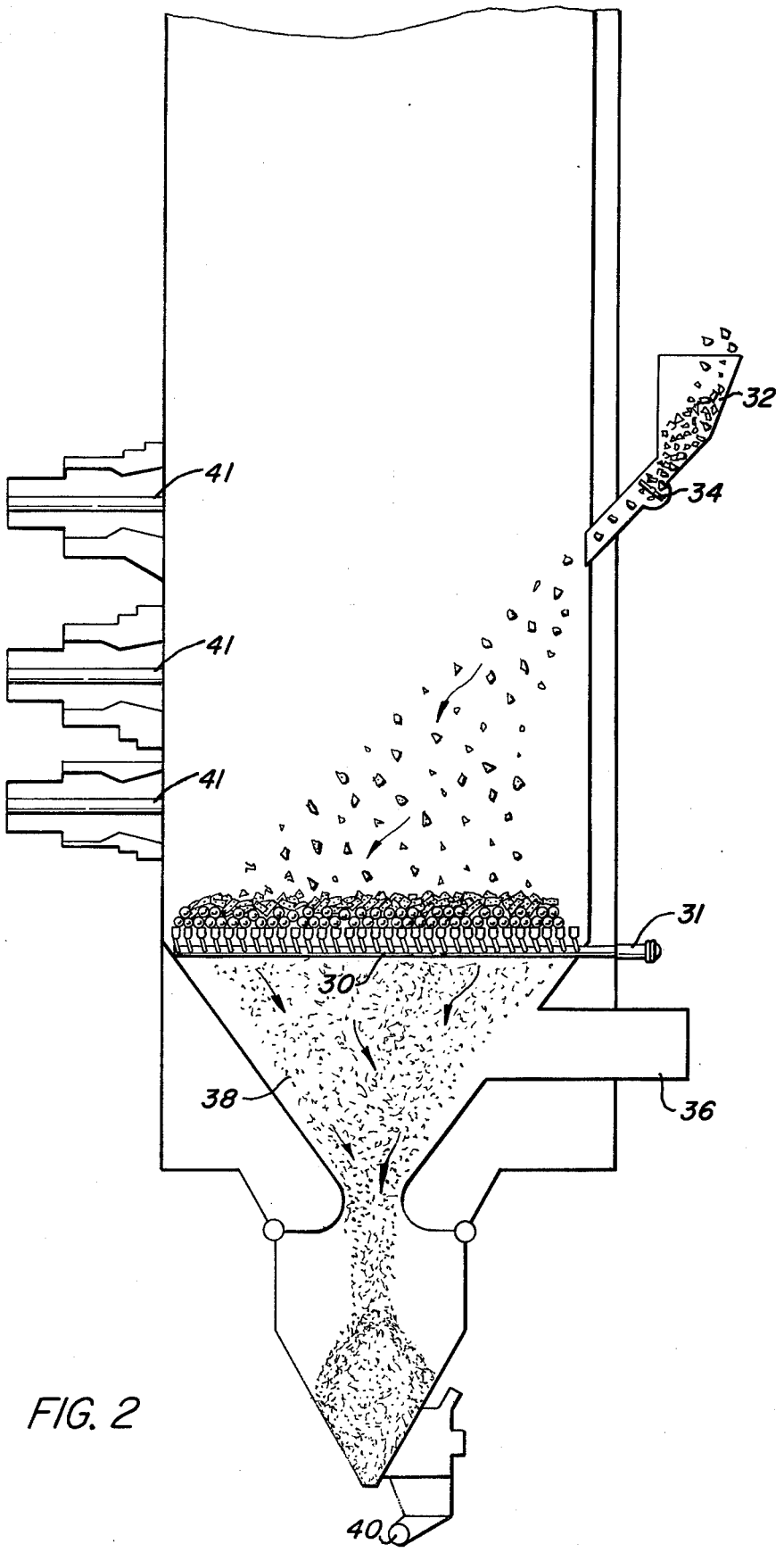
FIG. 2 is a section through the lower portion of a boiler equipped with a stationary grate stoker.

FIG. 2 shows the lower portion of a typical combustion chambe provided with a typical stationary or dumping-grate stoker equipped for burning waste particles. It could be a traveling grate. The grate 30 is provided with shaker means of any usual type (not shown) operating on the extension 31. The particulate material is fed from the hopper 32, which is provided with propelling means 34 so that the particles are spread over the whole width of the grate. Air for the combustion of the waste is introduced through the conduit 36 into the ash collecting means 38 and passes up through the grate. The grate is shaken continuously or at intervals. The balls are sufficiently large to remain on top of the grate when it is shaken. Only the ash goes through the grate and it is collected by suitable disposal means 40. Gas and/or oil is supplied through the feed means 41 and burns in the combustion chamber above the grate. Overfired air will usually be supplied, as required. If the waste contains any substantial amount of sulfur, the amount of gas and/or oil introduced into the combustion chamber is so regulated that the exhaust gases contain no more than a permitted maximum of sulfur dioxide.

Alternatively, the incombustible particles may be of such a size that they pass through the grate with the ash, when the grate is shaken. In this case, they may be separated from the ash and returned to the hopper 32 and are then fed onto the bed of incombustible matter with the waste.

Figure 3:
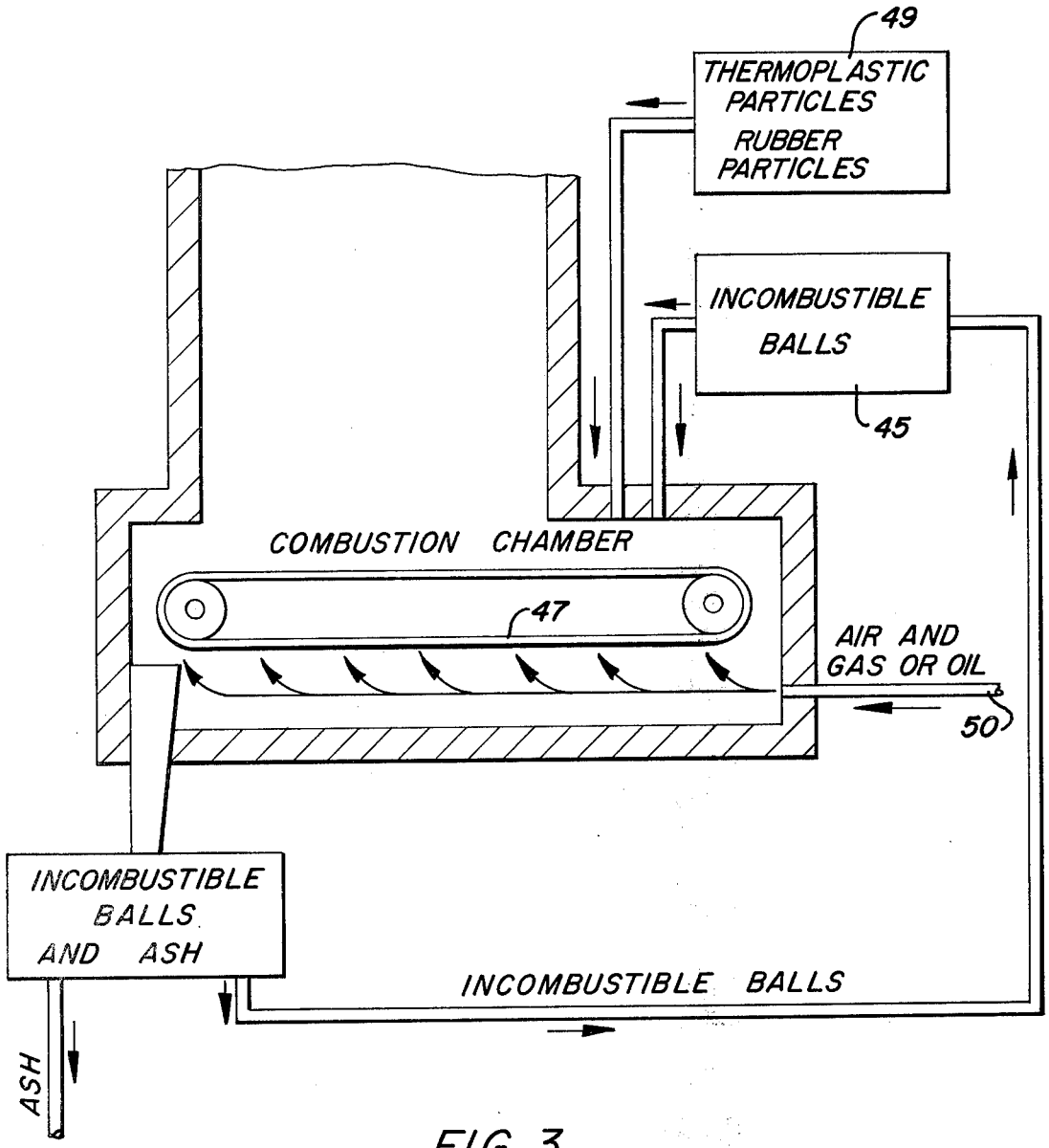
FIG. 3 is a diagrammatic showing of a combustion chamber designed for the disposal of waste without utilization of the generated heat.
Figure 4:
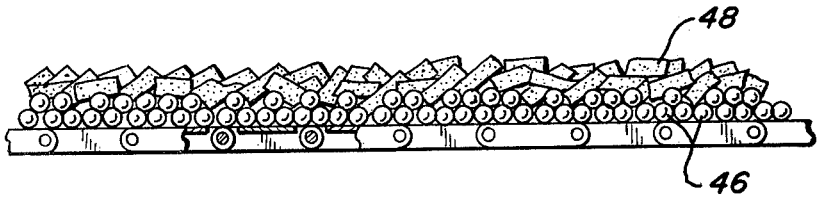
FIG. 4 is an elevation of a portion of the grate shown in FIG. 3.

FIGS. 3 and 4 show means 45 for depositing a bed of incombustible balls 46 across the continuous grate 47, and then supplying particles of waste 48 from supply 49 on top of the bed of balls 46. Air is supplied through 50 to the chamber, under the grate, to supply the air required for combustion. The balls and ash from the waste are dumped from the end of the grate into receiver 52, where the balls are separated from the ash and returned to the supply means 45 for re-use. Gas and/or oil may be supplied to the chamber, if desired, but if the chamber is designed merely for the disposal of waste, this is not necessary except to provide a pilot light.

Figure 5:
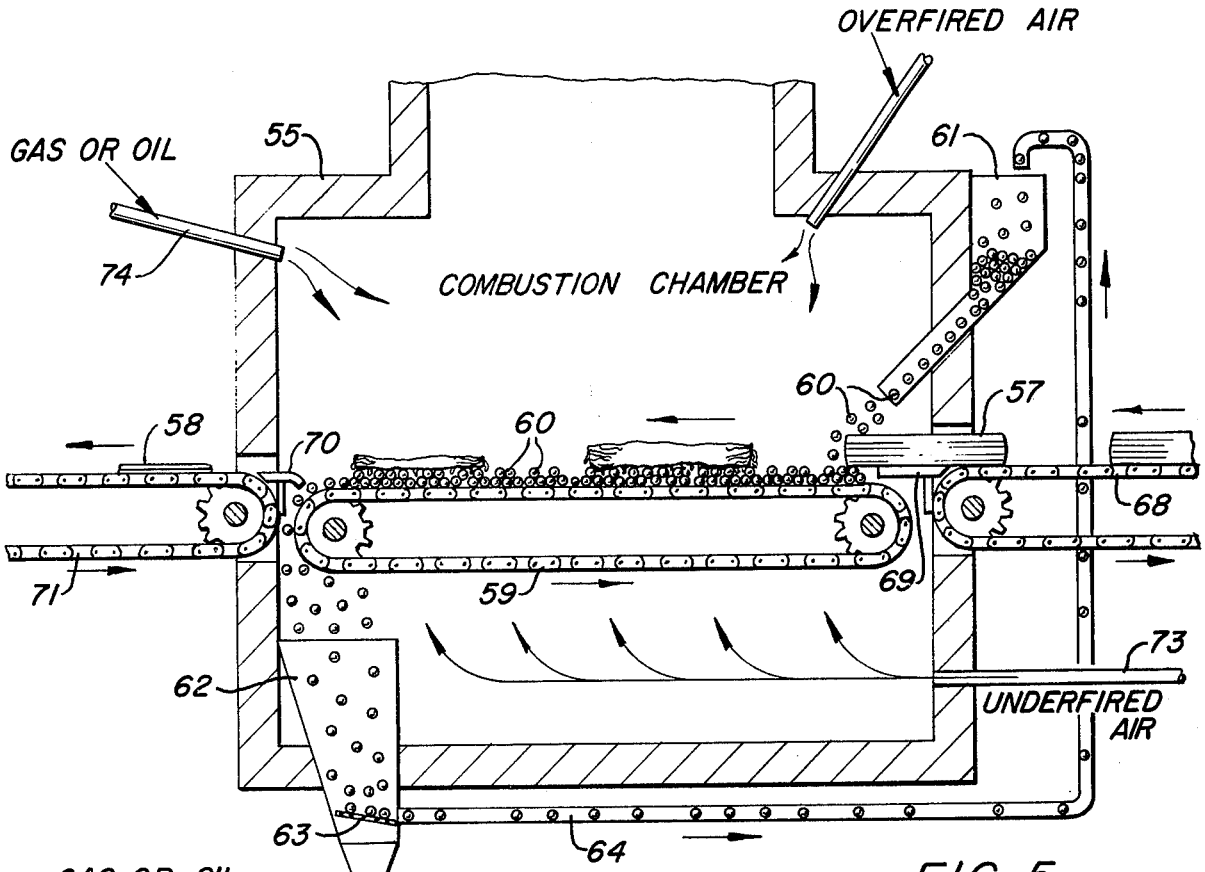
FIG. 5 is a section through the lower portion of a combustion chamber equipped to burn whole tires.
Figure 6:
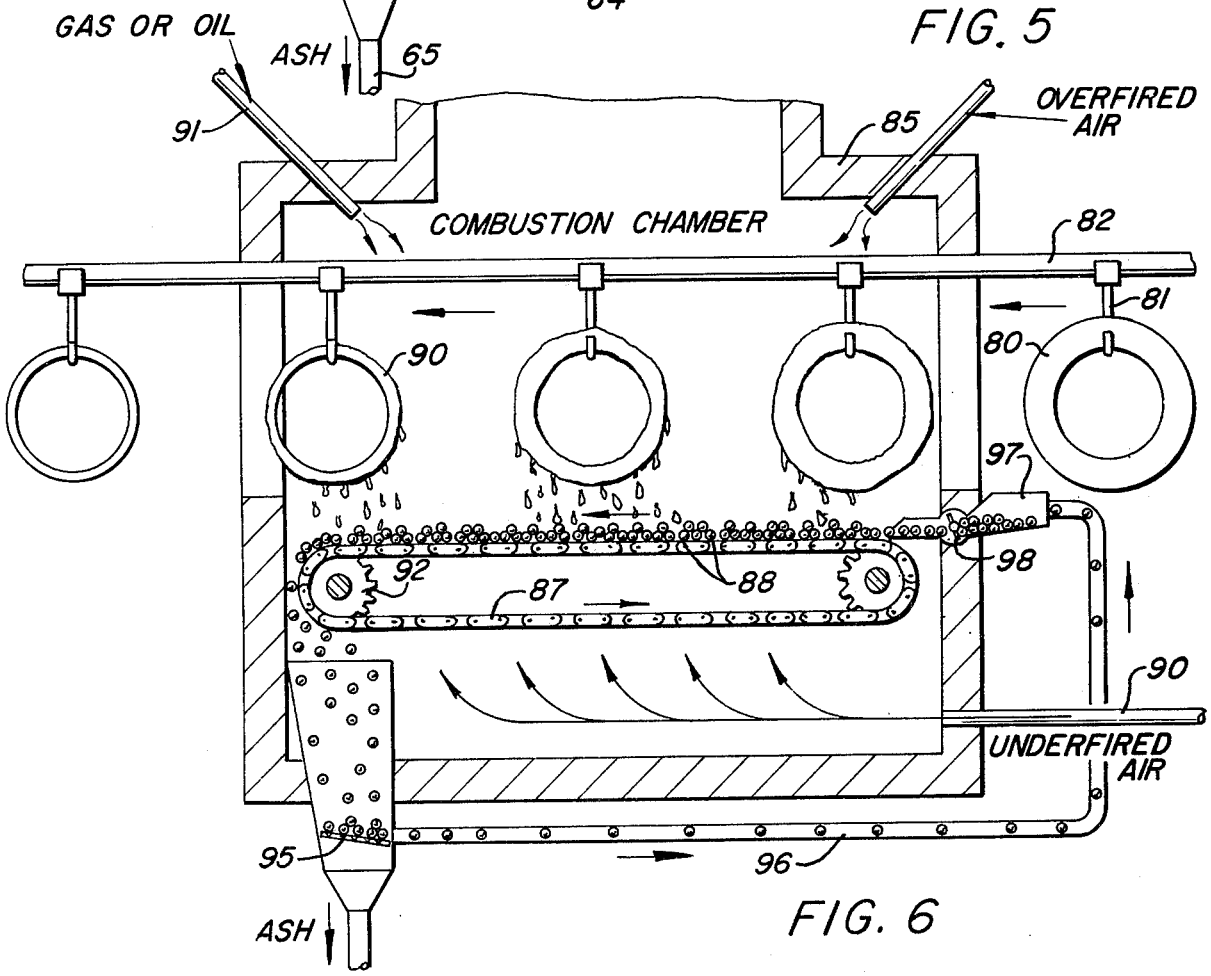
FIG. 6 is a section through the lower portion of a combustion chamber through which a continuous conveyor is passing with tires suspended from hooks on the conveyor.

FIGS. 5 and 6 indicate different types of equipment that may be used for burning old tires.

The combustion chamber 55 of FIG. 5 is provided with an opening on one side for the introduction of whole, used tires 57 and an opening on the opposite side for the removal of beads and possible adhering incombustible matter 58. Within the chamber there is a continuous grate 59, and incombustible balls 60 are fed onto the grate from hopper 61 and form a bed thereon. These balls together with ash are discharged from the other end of the grate into the receiver 62 where the balls are separated from the ash by the screen 63. The balls are returned by means 64 to the hopper, and the ash is delivered through the outlet 65 for any suitable disposition.

Whole, used tires or any part thereof are delivered into the combustion chamber from the continuous conveyor 68 by the shelf 69, and the beads and any incombustible matter are delivered from the top of the bed of balls over the shelf 70 onto the continuous conveyor 71. The beads are carried on this conveyor to any suitable discharge point.

Air is introduced into the chamber through means 73 and passes up through the grate and supports combustion of the rubber of the tires which are on the bed of incombustible matter. Gas and/or oil are supplied through other suitable means 74, usually above the grate. As the tires burn, the rubber melts and burns and descends onto the bed of incombustible balls which prevents any substantial amount of the melted material from reaching the grate. Ash from the burned rubber may adhere to the balls, but ordinarily the tumbling of the balls as they are discharged from the grate into the receiver 62 is sufficient to separate any ash which may cling to the balls. If necessary, the balls may be cleaned before they are returned to the hopper 61.

The tires may be fed onto the bed of incombustible matter in any desired manner. They may be fed one after another in a single line, or the conveyor may be wide enough to carry two or more tires side by side. The tires may be piled on top of one another in an orderly fashion or hit and miss.

Although the apparatus shown in FIG. 5 is designed primarily for the burning of whole tires, with introduction of gas or oil so that the exhaust gases do not exceed a predetermined maximum, apparatus of this general type may be used for the burning of other large materials, including materials which on burning do not generate sufficient sulfur dioxide to create a pollution problem. For this purpose generally no gas or oil is introduced above the grate, although some pilot means is provided to initiate the burning of the waste.

The speed of the grate 59 is regulated so that the tires or other waste are burned to ash by the time they have traveled the length of the grate. This grate 59 may travel at a faster or slower speed than the grate 68 and 71. If the tires are widely separated on the bed of balls, it is usually desirable to feed a certain amount of gas and/or oil under the grate to initiate and maintain combustion of the tires or other waste. The speed of the grate 59 is so regulated that any combustible matter on the tires is consumed before the remaining skeletons of the tires reach the shelf 70. The supply of gas and/or oil to the combustion chamber is so regulated that the gases from the burning of such fuel mixed with the gases produced by the tires, produces a mixed gas of such low sulfur dioxide content that there is no objectionable pollution of the atmosphere.

In FIG. 6, whole tires 80, supported on hooks 81 fastened to the continuous conveyor 82, are introduced through one wall of the combustion chamber 85 and discharged through the other wall. They may pass through mere openings in the walls or the walls may be provided with automatic or other closure means which prevents contamination of the surrounding atmosphere from gases generated within the combustion chamber and/or reduces the amount of air that enters the chamber from the outside.

The chamber is provided wth a grate 87 which is preferably a continuous grate, and a bed of balls 88 or other incombustible particles is maintained on the grate.

The chamber is provided with an air inlet 90 which feeds air into the chamber under the grate, and the air passes up through the grate and supplies air for burning whatever melted matter or fragments of the tire have fallen onto the bed of incombustible matter. Gas and/or oil is introduced usually above the grate, as through burner 91 and some air enters the chamber through the openings provided for the passage of the tires in and out of the chamber. Thus, air is provided for combustion of the tires and for burning gas and/or oil in the gases. Some of the rubber of the tires melts and drops onto the bed of incombustible matter where it is burned by the air which passes up through the grate, and other rubber usually adheres to the beads until it is consumed. The temperature within the chamber and the rate of speed of the conveyor 82 are controlled so that the rubber starts to melt and burn soon after each tire enters the combustion chamber until no combustible matter remains on the metal beads 90 which remain on the hooks as the tires leave the chamber. During the combustion of the tires, large or small segments of the tire — particularly tires which show severe signs of wear when they are placed on the hooks — fall from the tires and are burned on the bed of incombustible balls together with the melt which collects there. Sufficient air must be forced up through the bed of incombustible matter to burn the accumulation of waste collected on the bed.

The grate is shown as a continuous grate which will discharge the balls as it turns down around the gear 92. Usually the ash from the waste will be removed from the balls as they spill over the end of the continuous grate, although it may be necessary to provide means to insure removal of all of the ash. As the balls fall on the screen 95 they are diverted and returned through suitable conveyor means 96 to the hopper 97 from which they are expelled by the propeller 98. Any suitable means for providing a bed of the balls across the width of the grate may be employed.

The hooks on the conveyor may be arranged in any suitable manner, and FIG. 6 is merely suggestive of one arrangement. There may be hooks at the edges and between the edges of the conveyor so that several lines of tires are moving simultaneously through the chamber. The rate at which the conveyor 82 travels is controlled so that the combustible matter is entirely removed from the beads 90 as they leave the chamber. Means for shaking or otherwise removing the ash from the beads may be provided within the chamber of after the beads leave the chamber.

Other means for the combustion of old tires, or other large pieces of waste, is illustrated in FIG. 7. The upper conveyor 100 is formed of chains 101 and 102 (FIG. 8) which support cross-bars 104. These bars are spaced to provide adequate space between them to allow melt drops 106 from the tires to pass between them. There is no possibility of these openings becoming clogged by the drip. The drawing is illustrative, and the belt may be much wider to accommodate a plurality of tires side by side and two or more deep, and the openings may be much smaller without danger of their becoming clogged by the drip. Some drip may char and cling to the cross bars 104 so that it is necessary to clean them continuously by providing suitable scraper means, or by cleaning them at intervals when the apparatus is not being used.

Air is supplied to the combustion chamber through conduit 107 under the low conveyor 108 which supports the bed of incombustible balls 109, and delivers them to the chute 110 for return by suitable means indicated by 111, for return to the lower conveyor through the hopper 112, which may be provided with the dispensing means 113. If the apparatus is used for tires it is necessary to supply gas and/or oil to maintain the sulfur dioxide content of the gases below the predetermined maximum. The drawing indicates their admission through conduit 114, although special means may be provided and most or all of the gas and oil may enter the chamber above conveyor 100, whereas some and usually all of the air will enter the chamber, probably through scattered openings, under the grate 108 to supply oxygen for combustion of drip on the balls 109 as well as combustion of the falling drops and the tires 115. The tires are usually supplied on a continuous conveyor 116, and the beads 117 after burning of the combustible matter are discharged through chute 118 for suitable disposal. The gases may be used for heating a boiler or for any desired purpose.

A second conveyor 108 is shown with a bed of incombustible balls 109 for collecting and burning the melt, etc. which drips from the tires, because this is a most practical way of doing this. Other means may be provided. Some oil and/or gas will be supplied to the lower part of the combustion chamber to burn the matter on the balls 109, if required. The drip may be collected and burned or be otherwise disposed out in any other practical manner, as by collecting it and conveying it away from the combustion chamber for burning or other disposition.

Figure 9:
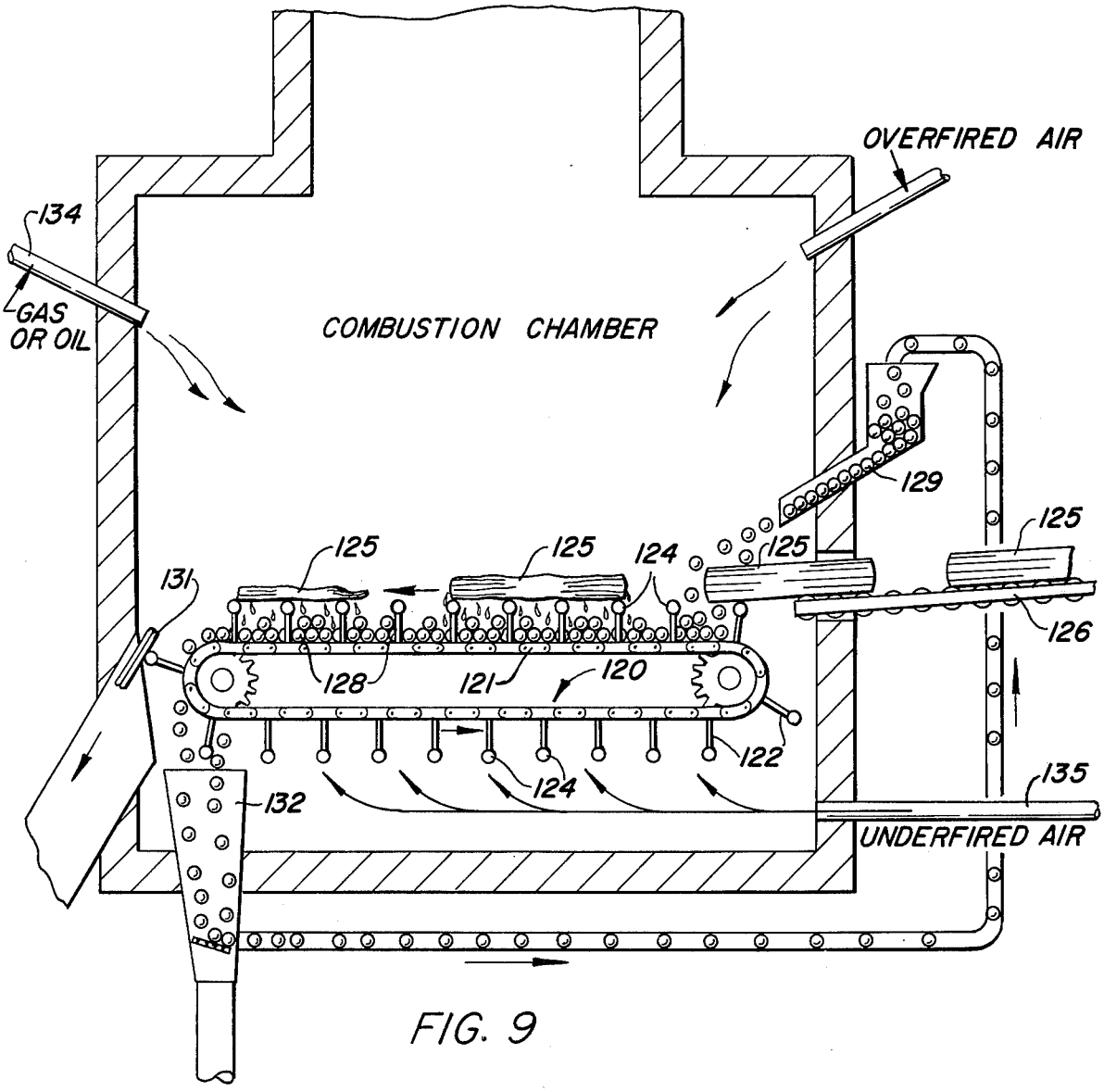
FIG. 9 is a section through the lower portion of a combustion chamber in which is a conveyor with projecting pins holding rods with tires supported by the rods.
Figure 10:
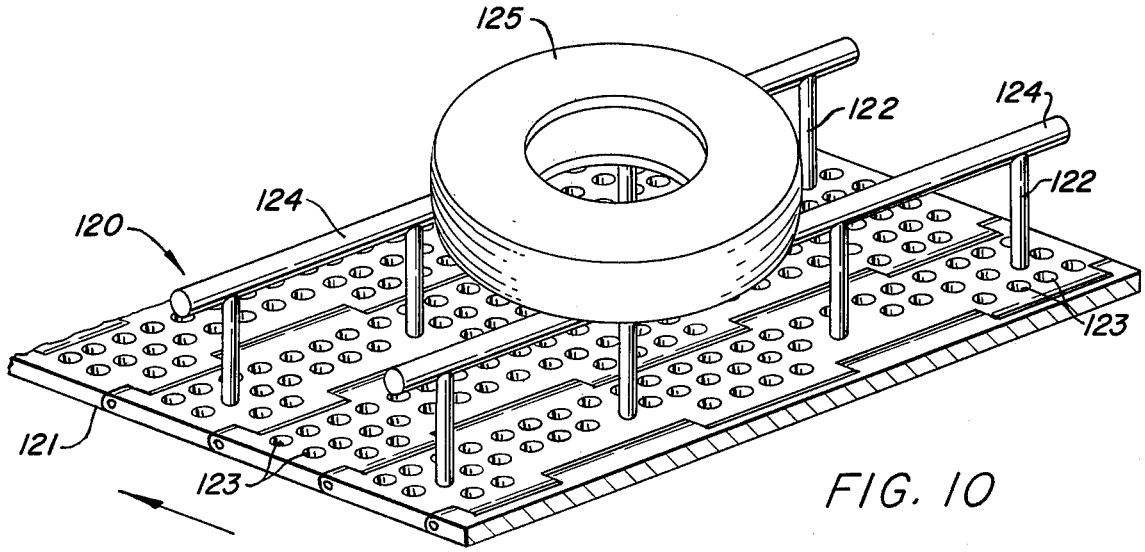
FIG. 10 is a pictorial view of the conveyor carrying tires with a central portion broken away.

FIGS. 9 and 10 illustrate the furnace such as shown in FIG. 9 with a conveyor such as illustrated in FIGS. 7 and 8. However, the conveyor, composed of flights 121, is provided with pins 122 attached to every other flight and there are openings 123 in the flights which permit the air to pass upwardly therethrough. Rods 124 are supported by the pins. Used tires 125 are supported on the rods 124. They are supplied by a conveyor 126 or other suitable means, or may be hoisted onto the rods by hand if desired. The tires are usually located on the rods in a rather helter-skelter fashion, the rods being long enough to support several tires arranged across the conveyor and the tires may rest to some extend on one another.

The conveyor 120 is covered with balls or other incombustible units 128 supplied from a chute 129 similar to the chute shown in FIG. 7 or supplied in any other manner so as to form a bed on the conveyor 120 which catches the melt or drip from the burning tires. Air passes up through the bed of balls. Some drip may pass through the upper expanse of the conveyor and be consumed before it passes through the lower expanse. The tires are completely burned as they pass through the combustion chamber and the beads 131 which are incombustible are delivered from the opposite end of the conveyor and are usually collected separately from the balls which are collected in means 132. Usually, the balls are conveyed to the chute 129 for re-use. Oil and/or gas is supplied through opening 134; air is supplied through opening 135. As required, the supply of gas and/or oil is regulated so that the sulfur dioxide content of the flue gases does not exceed a predetermined maximum.

The exhaust gases may be used to heat a boiler or be used for other purposes. If the sulfur dioxide content of the exhaust gases is to be controlled, this is done by regulating the proportionate amounts of sulfur-containing waste material and the fuel supplied to the combustion chamber.

The various means and processes described are illustrative of what might be employed, and the invention is not limited thereto. As shown, any combustion chamber used in the process is supplied with air supply means below the grate and gas and/or oil above the grate, but combustion may be assured in any desired manner. It is even possible to use coal of lower sulfur content than the waste that is burned. Usually it will be supplied in finely powdered form.

EXAMPLES

Meltable, combustible waste, such as whole used tires and comminuted tires, etc. can be burned in an incinerator chamber supplied with sufficient air. A fuel supplement such as fuel oil and/or natural or manufactured gas or even coal may be used to start the combustion, and to keep the material burning, if required. The process may be either a batch or continuous operation. Using any fuel which yields a gas of lower sulfur content than the maximum permissible under any existing environmental requirements, and blending the gases with the gases from burning sulfur-dioxide-producing waste, a gas of lower sulfur-dioxide content than the environmental requirement is obtained. The following examples illustrate how the proportion of oil and gas is to be blended with the gas of high sulfur-dioxide content from burning waste may be calculated.

The examples refer to the fuel used to produce 60,000 pounds of steam per hour, there being 1300 British thermal units (BTU) in a pound of steam. The heat required to supply 1300 BTU for 60,000 pounds of steam is 78,000,000 BTU.

The examples assume that the tires or other waste yield 15,000 BTU in an hour and contain 1 pound of sulfur, and this produces 2 pounds of sulfur dioxide ($SO_2$) per hour in the flue gas.

The examples assume that the maximum $SO_2$ permissible in waste gases is 1 pound of $SO_2$ for each million BTU fired.

EXAMPLE 1

This calculation is based on the use of fuel oil which contains 0.3 per cent of sulfur and generates 20,000 BTU per pound, and since there is approximately 7 pounds of oil in 1 gallon, and 1 gallon of oil generates 140,000 BTU.

The heat input is 60,000 lbs. steam/hr. × 1300 BTU.

60,000 steam/hr. × 1200 BTU = 78,000,000 BTU/hr.

Letting X = number of pounds of rubber burned per hour and Y = number of pounds of oil burned per hour, the heat equation is $15000X + 20{,}000Y = 78{,}000{,}000$ BTU per hour The permissible total permitted $SO_2$ per hour is therefore 78 pounds of $SO_2$, and the permitted total sulfur consumption is 78 pounds per hour ÷ 2 or 39 pounds per hour.

There being 1% of sulfur in the rubber and 0.3% in the oil, the sulfur equation is $0.01X + 0.003Y = 39$ Solving simultaneous equations we have $0.003Y = 39 - 0.01X$ and multiplying by 3.33 we have $Y = 13{,}000\text{-}3.33X$ and repeating a prior equation, we have $$
\begin{aligned}
&15{,}000X + 20{,}000Y = 78{,}000{,}000 \text{ BTU/hr.}\\
&\text{so, } 15X + 20(13{,}000-3.33X) = 78{,}000\\
&15X + 260{,}000-66.67X = 78{,}000\\
&-15.7X = -182{,}000\\
&X = 3{,}520 \text{ lbs. of tires burned in 1 hr.}\\
&Y = 13{,}000-3.33\text{x}3{,}520\\
&Y = 13{,}000-11{,}733\\
&Y = 1{,}267 \text{ lbs. of oil burned in 1 hr.}
\end{aligned}
$$

Thus, we find that by burning 1,267 lbs. of oil with 3,520 lbs. of tires per hour, the sulfur dioxide content of the flue gas is 78 lbs./hr.

EXAMPLE 2

This calculation is based on the use of gas as fuel, which gas contains an insignificant amount of sulfur.

As in Example 1, the heat input is 60,000 steam/hr. × 1300 BTU = 78,000,000 BTU/hr.

As in Example 1, the total permitted sulfur consumption is 39 lbs./hr.

The gas generates 1000 BTU per cubic foot.

Letting X = number of pounds of rubber burner per hour and Y = the number of cubic feet of gas burned per hour, the heat equation is $1500X + 1000Y = 78{,}000{,}000$ BTU/hr.

The sulfur equation is simply $$
\begin{aligned}
&.01X = 39\\
&\text{or } X = 3900 \text{ lbs./hr. of tires burned}\\
&1500 \times 3900 + 1000Y = 78{,}000{,}000 \text{ BTU/hr.}\\
&58{,}500{,}000 + 1000Y = 78{,}000{,}000\\
&1000Y = 19{,}5000{,}000\\
&Y = 19{,}500 \text{ cu. ft. gas/hr. burned}
\end{aligned}
$$

Thus, 3900 lbs. of tires burned in 1 hour with 19,500 cu. ft. of gas generates 78 lbs./hr. of sulfur dioxide.

The apparatus employed may be a modification of existing equipment, but new equipment may be used equally well. The sulfur-dioxide content of the flue gas may be controlled, but there are locations where no such control will be required. Also, in some installations, some air will be supplied to the combustion chamber above the grate as well as below it, and some of the fuel may be supplied under the grate.

I claim:

1. The method of burning used whole tires which comprises feeding the same above and out of contact with a bed of particles of incombustible matter supported on a grate having openings therethrough, and supplying air through said openings to support the burning of the waste while substantially completely surrounding them with air, and preventing any substantial amount of melt from the burning waste descending onto the grate by intercepting the same by said particles of incombustible matter, the particles being larger than openings in the grate.

2. The method of claim 1 in which the grate is a continuous grate and it is moved continually in a substantially horizontal plane, the incombustible matter is fed onto the upper expanse of the moving grate near one end thereof, the tires are fed above one end of the bed of incombustible matter and held out of contact therewith as the bed moves with the grate, and both (1) ash from the burning of the tires and (2) particles of incombustible matter are dumped off the opposite end of the moving grate.

3. The process of claim 2 in which the particles are returned onto the grate and reused.

4. The process of claim 2 in which the particles are balls.

5. The process of claim 1 in which the grate is a stationary shakable grate and the particles of incombustible material are so large that when the grate is shaken the particles remain on the grate.

6. The method of burning sulfur-containing waste which comprises burning the waste in an oxygen-containing atmosphere and producing a gas containing sulfur dioxide, burning fuel in the atmosphere and producing therefrom a gas with a lower sulfur dioxide content than the gas from the waste, and regulating the proportion of the amounts of the gas from the waste and from the fuel so that the sulfur dioxide of the gas composite is maintained below a predetermined maximum.

7. The process of claim 6 in which used whole tires are burned with fuel and the tires have a sulfur content so high that on combustion the gas produced has a sulfur dioxide content in excess of a desired maximum, the burning fuel produces a gas with a sulfur dioxide content below said maximum, and the gases are blended in such a proportion that the sulfur dioxide content of the resulting total gas does not exceed said predetermined maximum.

8. The process of claim 7 in which the tires are burned in a substantially horizontal position over a bed of incombustible balls on a moving grate and melt from the burning tires is caught on the bed and burned thereon.

9. The process of claim 7 in which used whole tires suspended from a moving conveyor are burned over a bed of incombustible balls on a moving grate, and melt from the burning tires is caught on the bed and burned thereon.

10. The method of claim 7 in which used tires are burned while being carried through a combustion chamber on or above a bed of incombustible particles on a grate and air is passed up through the grate and the bed.

11. The process of claim 10 in which the melt from the tires drops on continuously moving bed of balls of incombustible matter while air is passed up through the bed.

12. The process of claim 7 in which the tires are moved through the chamber supported on a conveyor, and the melt from the tires drips through openings in the conveyor which are so large that they do not become clogged by combustion of the drip, and the drip is collected below the conveyor and burnt to ash within the combustion chamber.

13. The process of claim 12 in which a second conveyor moves through the chamber below the first conveyor and a bed of incombustible balls on the second conveyor collects the drip and it is consumed thereon.

14. A combustion shamber with a grate with openings therein, means for spreading a bed of incombustible particulate material over the grate, the particles of the particulate matter being too large to enter the openings, means for conveying whole tires through the chamber above the bed, and means for introducing air into the chamber.

15. The combustion chamber of claim 14 with means for supplying oil and/or gas into the chamber above the bed.

16. The combustion chamber of claim 14 in which the grate is a continuous grate and conveyor means is provided for supplying used tires above the bed.

17. The combustion chamber of claim 16, with means attached to the grate for supporting tires above the balls and moving them through the chamber.

18. The combustion chamber of claim 14 in which the grate is a continuous grate and above the grate is a continuous conveyor with hooks thereon each adapted to hold at least one tire suspended therefrom, a part of the conveyor being within the combustion chamber and at least one part which joins one end of said part being out of the combustion chamber.

19. A combustion chamber, continuous conveyor means adapted to support used tires and move them through the chamber, and below said conveyor and separate therefrom means movable under said conveyor means for collecting drip from the burning tires and removing from the chamber the ash derived therefrom.

20. The combustion chamber of claim 19 in which the means below said conveyor comprises a second conveyor with openings therethrough and incombustible balls thereon which are too large to go through said openings, and means for moving said second conveyor through the combustion chamber.

21. The method of burning whole used tires from which the beads have not been separated, which method comprises burning the tires on a bed of particles of incombustible matter on a moving grate, which grate has openings therethrough, and after at least a substantial part of the rubber has been burned away from the beads, separately removing the beads and the incombustible matter from the grate.

22. The process of claim 21 carried out in a chamber with first and second openings in opposite walls thereof, moving the grate within the chamber from near the first opening to near the second opening, supplying the tires automatically through the first opening onto the grate and removing the tires automatically from the grate through the second opening and discharging the incombustible matter from the grate within the chamber near the second opening.

23. The process of claim 22 in which the discharged incombustible matter is supplied on to the grate near the first opening.

24. The process of claim 22 in which air to support the burning of the rubber is introduced into the chamber under the grate.

25. A combustion chamber with a continuous grate therein, means for moving the upper span of the grate away from an opening in a wall of the chamber, and a conveyor for automatically supplying whole tires in a substantially horizontal position through the opening on to the grate.

26. A combustion chamber with a continuous grate therein, with means for moving whole tires with the beads therein on the upper span of a continuous grate in the chamber toward an opening in a wall of the chamber and burning combustible matter from the beads, and means for automatically removing the remaining beads from the grate through said opening.

* * * * *